United States Patent [19]

Ashcraft et al.

[11] Patent Number: 4,480,026

[45] Date of Patent: Oct. 30, 1984

[54] STABLE DISPERSIONS FOR USE IN PHOTOGRAPHIC FILM HAVING AN OPAQUE BACKING LAYER

[75] Inventors: Robert W. Ashcraft; Rusty E. Koenigkramer, both of Towanda, Pa.

[73] Assignee: E. I. Du Pont de Nemours and Company, Wilmington, Del.

[21] Appl. No.: 404,375

[22] Filed: Aug. 2, 1982

[51] Int. Cl.[3] ..... G03C 1/84

[52] U.S. Cl. ..... 430/510; 430/523; 523/351; 524/503; 525/56

[58] Field of Search ..... 430/220, 510, 530, 523; 524/503; 523/351; 525/56

[56] References Cited

U.S. PATENT DOCUMENTS

| | | | |
|---|---|---|---|
| 2,271,234 | 1/1942 | Staud et al. | 95/9 |
| 3,677,790 | 7/1972 | Bishop et al. | 117/33.3 |
| 3,790,653 | 2/1974 | Barkey et al. | 264/171 |
| 3,900,323 | 8/1975 | MacLeish et al. | 430/510 |
| 3,993,486 | 11/1976 | Oishi | 430/207 |
| 4,088,487 | 5/1978 | Bloom et al. | 430/510 |
| 4,211,837 | 7/1980 | Blake et al. | 430/502 |
| 4,233,392 | 11/1980 | Friedel | 430/264 |
| 4,254,208 | 3/1981 | Tatsuta et al. | 430/215 |
| 4,272,594 | 6/1981 | George et al. | 430/510 |
| 4,357,416 | 11/1982 | Fan | 430/302 |

*Primary Examiner*—J. Travis Brown

[57] ABSTRACT

In preparing an opaque backing layer for a photographic film, superior covering power and coating dispersion stability are obtained by (1) dispersing carbon black in a minor phase of polyvinyl pyrrolidone/vinyl acetate copolymer before addition of a major phase of polyvinyl alcohol, and (2) delaying the addition of surfactant or coating aids until after complete mixing of the polyvinyl alcohol with the solid carbon black dispersion. This coating dispersion is particularly useful for the preparation of a dischargeable opaque backing layer for a diffusion transfer film element.

6 Claims, No Drawings

STABLE DISPERSIONS FOR USE IN PHOTOGRAPHIC FILM HAVING AN OPAQUE BACKING LAYER

BACKGROUND OF THE INVENTION

1. Technical Field

This invention is in the field of photographic film, and in particular relates to opaque backing layers which are coated on a photographic support. More particularly the invention relates to dispersions of carbon black and polymer for use in preparing an opaque backing layer which can be removed in the fluids used during the processing step in which the photographic image is fixed.

2. Discussion of the Prior Art

The addition of so-called "backing layers" to one side of a film support containing a photographic silver halide layer coated on the other side of the support, is well-known in the art. These layers are applied for various reasons: as anti-halation layers, anti-friction layers, anti-static layers and protective layers, for example. Carbon black may be used as the opacifying agent for such purposes, e.g., in anti-halation layers, as described in U.S. Pat. No. 2,271,234, or for providing an opaque backing layer for diffusion transfer type photographic elements in which a reusable negative can be obtained, as explained in U.S. Pat. No. 3,677,790. In U.S. Pat. No. 4,211,837, Blake et al., removable opaque backing layers for photographic silver halide elements are described in which the opaque backing layer contains carbon black, a polymeric binder, and a scavenging agent such as a silver halide or silver nitrate, deactivating for impurities in the carbon black. The carbon black is dispersed in a binder, with conventional additives such as surfactants and coating aids, and the resulting dispersion or slurry is stored until needed. The problem with this is that such dispersions are not storage-stable for more than a few days, after which phase separation takes place.

It is an object of this invention to provide a dispersion of carbon black in polymer which is storage-stable and suitable for coating as a high density opaque backing layer.

It is a further object to provide a stable carbon black dispersion of improved coatability which is especially useful for forming a high density removable opaque backing layer on a photographic diffusion transfer element.

SUMMARY OF THE INVENTION

A photographic element is prepared by coating a support on one side with a photosensitive silver halide emulsion layer and on the other side with an opaque backing layer containing an opacifying agent, characterized in that the coating composition for the backing layer is prepared by these steps: (1) Carbon black, suitably prewetted, is two-roll milled with polyvinyl pyrrolidone/vinyl acetate copolymer to produce a solid dispersion; (2) the solid dispersion is added to and mixed with a PVA (polyvinyl alcohol polymer) solution, and (3) suitable plasticizers, surfactants and coating aids are then added in order to retard foaming and cratering when the composition is coated on a support to produce an opaque backing layer. The foregoing sequence is essential. The composition is storage-stable and the layer has high covering power.

A subcombination of the invention comprises a process for preparing a photographic support wherein a base is coated with a dispersion comprising PVA, carbon black, polyvinyl pyrrolidone/vinyl acetate copolymer, plasticizer and surfactant, and the coating is dried to produce an opaque layer, characterized in that the aforesaid dispersion is prepared by the step of:

(1) dispersing prewetted carbon black in solid polyvinyl pyrrolidone/vinyl acetate copolymer, preferably by 2-roll milling, to form a solid dispersion of carbon black in polyvinyl pyrrolidone/vinyl acetate copolymer;

(2) adding said dispersion to a PVA solution, with stirring; and (3) subsequently adding one or more surfactants or coating aids to stabilize the dispersion.

DETAILED DESCRIPTION OF THE INVENTION

In Step (1) the liquid used to prewet the carbon black serves to swell or tackify the copolymer. The liquid may comprise one or more of the following: ethanol, methanol, isopropanol, acetone, methylene chloride, and methyl ethyl ketone. Due to the volatility of these liquids it may also be desirable to add an inert diluent with the swelling and tackifying liquid, such as hexane or heptane. In the two-roll mill process the materials are subjected to extremely high shear forces and considerable heat is generated. Thus, liquids will evaporate rapidly. A ternary liquid mixture for prewetting carbon black which was particularly useful comprised hexane, methylene chloride, and methyl ethyl ketone.

In Step (2) the PVA solution is preferably composed of polyvinyl alcohols of different molecular weights. Since no surface active agent is present it is necessary to keep the solution stirred while the solid dispersion is added. Mechanical stirring such as provided by a propeller blade is required to produce a finely divided dispersion of the carbon black-copolymer in PVA.

In Step (3) at least one surfactant is required to lower the surface tension and stabilize the dispersion obtained in Step (2). Since the final use of the dispersion is for coating an opaque backing layer, it is also desirable to add more than one surfactant as well as coating aids which will reduce or eliminate coating defects such as pinholes, streaks, bubbles, craters, squiggles, etc. One of the particular problems which exist is the presence of foam. As a result, a surfactant or coating aid may be chosen for its antifoaming properties rather than any primary effect on surface tension or dispersion stability.

It has been found in accordance with the present invention that a more stable dispersion can be achieved when the opacifying agent is dispersed in a minor phase (i.e., 18% solids) of vinyl pyrrolidone polymer rather than when dispersed directly into the major phase (i.e., 36% solids) of PVA. A dispersion prepared by the present invention shows a greatly reduced tendency for phase separation in comparison with a prior art dispersion when studied under the microscope. As the dispersions were examined over a period of days, progressive phase separation was observed only for the prior art method of dispersing the opacifying agent in PVA.

Since there is less polyvinyl pyrrolidone/vinyl acetate copolymer than there is PVA in the end product the result is unexpected. Improved covering power results when the addition of surfactants or coating aids is delayed until after the polymer binder or binders have been dispersed with the opacifying agent. By proceeding in this manner, stable dispersions which coat well to produce high density backing layers are provided, which contradicts the teachings of the prior art to place the carbon black in the major phase of PVA. It was surprising to find that superior results are obtained when the opacifying agent is placed in a minor phase and that all polymer additions are completed prior to the addition of any surface active agent capable of stabilizing the dispersion. Two concepts, (1) shifting the opacifying agent from the major PVA phase to the minor copolymer phase to increase stability, and (2) delaying addition of surfactant to increase covering power, contribute to producing a superior dispersion and coating process.

The preferred opacifying agent is carbon black having a particle size of from 1.5 to 70 millimicrons. Carbon black is prepared from incomplete combustion of natural gas or a liquid hydrocarbon and is available as channel black, furnace black and thermal black. For best results furnace black is employed in amount sufficient to yield an optical density of greater than 9.0 of the backing layer when it is coated on a film support and dried.

It is particularly preferred to formulate the backing layer so that it is removable in the fluids used during the processing of the element at the step when the image is fixed. To effect this, the binder component of the backing layer is water-permeable, yet not too soluble in the developing fluids. A particularly useful binder materials is a fully hydrolyzed PVA (e.g., at least 99% hydrolyzed) having a low molecular weight (e.g., a viscosity of about 4–6 centipoise, 4% aqueous solution at 20° C., as determined by the Hoeppler falling ball method). The binder is usually about 20–60% by weight of the backing layer with 40–45% being preferred. Another useful binder is a mixture of high molecular weight (e.g., viscosity of 55 centipoise or greater) fully hydrolyzed PVA and low molecular weight fully hydrolyzed PVA. The high molecular weight PVA may optionally be modified by copolymerization with other monomers. Another preferred mixture of binders is 98/2 high molecular weight PVA/methacrylic acid copolymer and low molecular weight PVA (75/25 weight mixture) wherein all the PVA is at least 99% hydrolyzed. Partially hydrolyzed PVA (e.g., about 85% hydrolysis) may also by used if proper crosslinking agents are also included (e.g., dimethylol urea, trimethylolmelamine, dimethylolethylene urea, triazone resins, and others well known to those skilled in the art). Still other water-permeable, yet cohesive, binding agents that will function are gelatin, polyacrylates and copolymers thereof, partial esters of poly(methyl vinyl ether/maleic anhydride), vinylidene chloride copolymers, and carboxymethyl and ethyl celluloses.

For the minor binder component it is preferred to use about a 60/40 weight mixture of a copolymer of polyvinyl pyrrolidone/vinyl acetate in order to prepare the solid dispersion. Based on total solids, this component is preferably present in concentrations from 6 to 37% by weight of the layer. Other binders which may work within the ambit of this invention include partial esters of poly(vinyl methyl ether) and nonylphenol polyethylene oxide; polyvinyl pyrrolidone/ethyl acetate; ethylene vinyl acetate; cellulose derivatives of the polysaccharides; polyvinyl acetate; and combinations of the above.

Plasticizers useful in the formulation of the backing layer include polyetherpolyol (4.5 functionality), which is preferred, glycerine, dibutylphthalate, dipropylene glycol, glycerol triacetate, sorbitol, triethylene glycol diacetate, 1,2,6-hexanetriol, polyethylene glycols, and tributyl phosphate. The preferred polyetherpolyol may be added in the range of 6–20% by weight of said layer.

Surfactants and coating aids may be added in accordance with in the present invention, i.e., once the solid dispersion of carbon black in polyvinyl pyrrolidone/vinyl acetate copolymer has been mixed with the PVA solution. Anionic or nonionic surfactants are preferred. Examples: octylphenoxy polyethoxy ethanol, sodium (bis tridecyl) sulfosuccinate, nonylphenol polyethylene oxide, 1,2 propylene glycol, tetramethyl decynediol, polyethylene oxide sorbitan mono-palmitate, ammonium sulphate, and sodium dioctyl sulfosuccinate. Some of those found to be effective in practicing the present invention are: Aerosol ®OT, Surfynol® 104, Triton ®X-100, Tween ®40, Igepal ®CO970, and Trokyd ® Latex Anticrater surfactants and coating aids.

The opaque layers described herein can be coated by any of the means described in the prior art on any common photographic film support. Suitable transparent film supports are listed in U.S. Pat. No. 4,211,837 supra, at col. 3, lines 28–56, which disclosure is hereby incorporated by reference. These include polyester films, which are particularly suitable because of their dimensional stability. By carefully adjusting the backing ingredients (e.g., binders, plasticizers, adhesion promoters and wetting agent), these layers may be prepared so as to adhere to any of the supports disclosed in the prior art.

In the most preferred embodiment of the invention, wherein the opaque backing layer is removable, it will adhere to the film support during exposure and development but will strip away when soaked in water or a salt solution (e.g., sodium sulfite) used for stabilizing the exposed and developed image. Overall, the invention has these advantages over the prior art, as represented, e.g., by Blake et al., supra:

1. Lower mill costs
2. Higher yields
3. Improved coating quality
4. Greater reproducibility and latitude
5. Greater stability of backing solution
6. Easier to handle
7. Simple backing solution preparation process
8. Only a two component dispersion instead of five.

The invention will now be illustrated by the following examples.

EXAMPLE 1

A 40.64×106.68 cm two-roll mill of the type available from Kobe Manufacturing of Japan powered by a 60 HP motor had one roll steam heated to between 74° to 85° C. The hot-to-cold roll drive ratio was 1:1.25. The roll gap was set at about 0.050 to 0.064 cm or about one third turn open from a closed position. A 99 kg. portion of Regal ®33OR (27 mζ particle size carbon black with 1% volatiles, available from Cabot Corp.) was prewetted with a mixture of 66 kg hexane, 44 kg methyl chloride, and 22 kg methyl ethyl ketone by slowly mixing for 10 minutes. Then a soft dough was formed by mixing the prewetted carbon black for 5 minutes with 121 kg. of polyvinyl pyrrolidone/vinyl acetate copolymer (PVP/VA S-630, a 60/40 copolymer available from General Aniline Film Corp.). The mixture was fed between the rolls. A shiny black sheet was extruded from the bottom of the two-roll mill. When cool this was easily broken up to produce chips which comprised 45% carbon black.

A 1000 liter container equipped with a 3 blade propeller mixer was charged with 170 kg deionized water at a temperature of 25° C. Under moderate stir rate 556 kg of a 10% Elvanol ®T-25G solution (96 PVA/4% methacrylate copolymer measured viscosity for a 4% aqueous solution 20° C. of 28 to 32 centipoise, available from E. I. du Pont de Nemours and Company) and 74 kg of a 13% Vinol ®107 solution (PVA of measured viscosity for a 4% aqueous solution 20° C. of 5 to 7 centipoise, available from Air Products & Chemicals, Inc.) were added to the water. Following the addition of these medium and low molecular weight polyvinyl alcohols 36.6 kg of the 45% carbon chips was added. Stirring continued for 2 hours until a homogeneous black coloration was obtained, indicating a good dispersion.

Other additions were made as follows to prepare the final coating composition: 4.7 kg. of a 10% Triton ®X-100 solution (Rohm & Haas); 18.2 kg of a 50% Voranol ®490 (Dow Chemical). This dispersion was stirred 1 hour, then filtered through 5 micron bag filters before coating, and finally applied to a resin-subbed polyethylene terephthalate base which had been biaxially oriented and heat-relaxed. After drying, the coating had a dry coating weight of 185 mg/dm$^2$ with an optical density above 10.

A drum of this dispersion was held for one month under room conditions and then recoated. Similar coating quality and optical density were obtained indicating that the dispersion was stable upon storage.

A comparison coating prepared according to U.S. Pat. No. 4,211,837 gave equivalent results when freshly prepared, but within one week at room conditions it was not possible to obtain equivalent coatings because of phase separation as shown by microscopic examinations. The compositions of the comparison coating was the same as the present invention except for the method of dispersion and the order of surfactant addition.

EXAMPLE 2

A 45% carbon chip was prepared as in Example 1 except that the carbon was prewetted with only methylene chloride. Into a 2000 liter tank was added 1034 kg deionized water, 75 kg Elvanol ®T25G, and 25 kg Vinol ®107. The tank was heated to 91° C. and held with slow stirring for 1 hour. Analysis revealed 8.7% solids, a Brookfield viscosity of 272 cps, and a pH of 6.7. A 143 kg portion of this solution was transferred to a 415 liter bottom outlet drum. Additions of 35 kg deionized water and 4.8 kg of 50% Voranol RN 490 (Dow Chemical) were made in order. Then 9.6 kg of the 45% carbon chips were added and stirred for 3 hours. Then 9.6 kg of an unsensitized 1.7% silver bromide photographic emulsion dispersed in PVA was added under safelight conditions. The final addition was 1572 g of a 10% solution of Triton ®X-100. Analysis showed 11.7% solids, pH of 5.7, and 165 cps viscosity.

The solution was coated to provide a 220 mg/dm$^2$ dry coating weight. When a sample of the opaque backing was placed in a 12% sodium sulphate solution the layer clearly peeled off in 19 seconds. The samples exhibited optical density above 9.0, an Instron test run at 25 cm/minute of over 15 g for adhesion, and high visual gloss.

A comparison test adding a fluorocarbon surfactant (FC-128 from 3M Co.) exhibited lower gloss (73 versus 84), and a higher level of pinholes (i.e., 6 to 9 per square foot versus 3 to 4). Comparative covering power values were Triton ®X-100=64 versus Triton ®X-100 plus FC 128 fluorocarbon surfactant=62. Covering power=Optical Density÷Coating Weight×1000.

EXAMPLE 3

Carbon chips were prepared similar to Examples 1 and 2 except using Raven ®1200, a 24 mμ particle size carbon black with 2.3% volatiles available from Columbia Carbon Corp. This illustrates that different carbon blacks are suitable for use in the present invention.

EXAMPLE 4

Different carbon chips as described in Examples 1, 2 and 3 were dispersed into a PVA solution under identical conditions. These carbon chips were at least one month old to allow evaluation of the capability of preparing stable liquid dispersions using the solid dispersion. In addition to the polymers and 0.63% by weight Triton ®X-100 surfactant used in Example 2 there was added 2% by wt. Troykyd ® Latex Anticrater coating aid (Batch 816-6437 available from Troy Chemical Co., 1 Ave. L, Newark, NJ 07105). As expected, the carbon chips with higher carbon content showed higher covering power, but all coatings gave very satisfactory end-use optical and physical properties with optical density over 9.0. These tests show that the carbon chips can be prepared and stored until needed without deterioration. Also the combination of Triton ® and Troykyd was found to be particularly effective in reducing the level of pinholes and craters.

EXAMPLE 5

Carbon chips containing 50, 55 and 60% carbon were prepared by the process of Example 1. At a 60% carbon loading the milling process was difficult and reproducibility became questionable.

A comparison of samples of the carbon chips prepared by the same process shows the expected increase in covering power as the carbon content is increased. Table 1 contain the comparative results.

TABLE 1

| % Carbon in Chip | Covering Power |
|---|---|
| 45 | 60 |
| 50 | 72 |
| 55 | 86 |
| 60 | 98 |

EXAMPLE 6

A 121 kg portion of Regal ®33OR carbon black was placed in a mixing hopper and slowly stirred for 10 minutes. Over a 7 minute period 132 kg of a mixture of 50% hexane, 33% methyl chloride, and 17% methyl ethyl ketone was slowly stirred into the carbon black. Care was taken not to extend the mixing period, based on past experience where excessive mixing caused set-up or hardening and the ingredients would not stick to the mill. Following the prewetting a 99 kg portion of polyvinyl pyrrolidone/vinyl acetate copolymer was mixed in over a period of 5 minutes to form a soft dough.

The mixture was divided into seven portions. The two-roll mill was set as in Example 1 with one roll heated to 80° C. and a portion was placed on the mill, where a band was formed. Every 20 to 30 seconds the band was cut off and reapplied. After a total of six minutes the band was removed from the mill and allowed to cool. The band temperature immediately after coming off the mill was measured at about 77° to 94° C. The band thickness was about 0.5 cm. The milling process was repeated until all seven portions had been formed into bands.

Upon cooling, each band was fed into a chipper to produce small cubes of 0.3 cm or smaller. The material was blended in the chipper and then placed in polyethylene bags inside of metal drums for storage. The process was repeated to prepare additional carbon chips.

The agitator was turned on to a tank containing 972 kg deionized water and checked to see that there was a pronounced vortex. 90 kg of Elvanol ®T-25G was slowly added. Then 30 kg of Vinol ®107 was slowly added. The solution temperature was allowed to rise to 90° C. The solution was maintained at a temperature of 90° to 100° C. for 60 minutes. The solution was allowed to cool and checked for percent solids and viscosity.

The resulting polyvinyl alcohol solution was pumped to a 2000 liter tank and filtered through 5 micron filter bags at a pressure below 40 psi. The temperature before pumping was 92° C. and after pumping was 85° C.

Moderate stirring was begun and 250 kg of a 50% Voranol solution was added. This was followed by a 1304 kg addition of deionized water. The solution temperature was recorded as 68° C. Then 508 kg of the 55% carbon chips was added. This was stirred vigorously for 8 hours.

A silver bromide dispersion in polyvinyl alcohol was prepared under subdued lighting. First 31 kg of deionized water was added to an 80 liter container. With moderate stirring 5 kg of a 10% Elvanol ®T-25G solution was added. After five minutes of stirring a 494 g addition of 3M potassium bromide was made. This was allowed to stir for 5 minutes and then a 455 g addition of 3M silver nitrate was made. After stirring for 15 minutes the dispersion was checked for pH and percent solids.

A 180 kg portion of the silver bromide dispersion was weighed out and added to the carbon black dispersion at the end of the 8 hour stirring period. Then 123 kg of Triton ®X-100 surfactant was added followed by a 6.3 kg addition of Troykyd ® latex anticrater surfactant-/coating aid. The solution was stirred for one hour and then filtered through 5 micron bag filters and tested for viscosity and percent solids.

The solution was coated and tested as in Example 1. The samples showed good covering power, (87), very good adhesion, (25 g Instron test) and a very low level of pinhole defects.

EXAMPLE 7

Carbon chips prepared in Example 6 were examined to determine latitude-to-temperature differences during dispersion preparation. A series of tests was run using exactly the same ingredients as in Example 6 but varying the solution temperature at the time of the carbon chip addition. The covering power was measured fresh and after holding the solution for one week. Table 2 gives results.

TABLE 2

| Solution Temperature | Covering Power | Covering Power After One Week |
|---|---|---|
| 24° C. | 87 | 87 |
| 40° C. | 87 | 87 |
| 65° C. | 87 | 84 |
| 80° C. | 76 | 84 |
| 93° C. | 72 | 77 |

As shown in the Table there is no indication of any adverse effect until the addition temperature goes above 65° C. Although the covering power is lower at 93° C. it is still acceptable. A 72 covering power will give an optical density greater than 9.0 when the coating weight is greater than 200 mg/dm$^2$. The temperature latitude shown in Table 2 is much better than the prior art method in which satisfactory results could not be obtained with a temperature above 75 C.

We claim:

1. A photographic element prepared by coating a support on one side with a photosensitive silver halide emulsion layer and on the other side with an opaque backing layer containing an opacifying agent, characterized in that the coating composition for the backing layer is prepared by this sequence: (1) polyvinyl pyrrolidone/vinyl acetate copolymer is two-roll milled with carbon black which has been prewetted with a liquid which will swell or tackify the copolymer to produce a solid dispersion; (2) the solid dispersion is added to and mixed with a polyvinyl alcohol solution, and (3) suitable plasticizers, surfactants and coating aids are then added.

2. A process for preparing a photographic support wherein a base is coated with a dispersion comprising PVA, carbon black, polyvinyl pyrrolidone/vinyl acetate copolymer, plasticizer and surfactant, and the coating is dried to produce an opaque layer, characterized in that the aforesaid dispersion is prepared by the steps of:

(1) mixing a polyvinyl pyrrolidone/vinyl acetate copolymer with carbon black which has been prewetted with a nonaqueous liquid which will swell or tackify the copolymers;

(2) two-roll milling the mixture to form an extruded sheet, and breaking up the dried sheet into carbon black chips;

(3) adding said carbon black chips to an aqueous polyvinyl alcohol solution, with stirring, to form an aqueous dispersion; and (4) subsequently adding one or more surfactants, plasticizers, or coating aids to stabilize the dispersion.

3. The process of claim 2 in which the carbon black is prewetted with a liquid comprising one or more members of the group consisting of methanol, ethanol, isopropanol, acetone, methylene chloride, and methyl ethyl ketone.

4. The process of claim 3 wherein a portion of the liquid comprises an inert diluent selected from the group consisting of hexane and heptane.

5. The process of claim 2 wherein step 3 is conducted at a temperature of not exceeding 65° C.

6. A storage-stable coating solution prepared by the steps of:

(1) prewetting carbon black with a nonaqueous liquid which will swell or tackify polyvinyl pyrrolidone/vinylacetate copolymer, (2) two-roll milling the prewetted carbon black with the copolymer to produce storage-stable carbon chips, (3) dispersing the carbon chips in a polyvinyl alcohol solution, and (4) adding one or more surfactants, plasticizers, or coating aids to stabilize the dispersion.

* * * * *